United States Patent [19]

de Turville

[11] 4,140,344

[45] Feb. 20, 1979

[54] EXTRACTION OF ORGANIC MATTER FROM MARINE SEDIMENT

[76] Inventor: Claude M. D. M. de Turville, 11, Christchurch Rd., Clifton, Bristol, United Kingdom, BS8

[21] Appl. No.: 829,135

[22] Filed: Aug. 30, 1977

[51] Int. Cl.[2] ..... E02F 3/88

[52] U.S. Cl. ..... 299/8; 37/61; 56/8; 209/46; 209/162; 299/9

[58] Field of Search ..... 219/8, 9; 209/45, 49, 209/46, 47, 162, 171, 4, 9; 37/54, 55, 61

[56] References Cited

U.S. PATENT DOCUMENTS

| | | | |
|---|---|---|---|
| 2,200,771 | 5/1940 | Dyer et al. | 209/171 |
| 3,540,194 | 11/1970 | Chaplin | 299/9 |
| 3,748,248 | 7/1973 | Wanzenberg et al. | 299/8 |
| 4,053,181 | 10/1977 | Saito | 299/9 |

FOREIGN PATENT DOCUMENTS

| | | | |
|---|---|---|---|
| 2554017 | 6/1977 | Fed. Rep. of Germany | 299/9 |
| 164503 | 12/1964 | U.S.S.R. | 37/54 |
| 253725 | 7/1970 | U.S.S.R. | 37/61 |

*Primary Examiner*—William Pate, III

*Attorney, Agent, or Firm*—Larson, Taylor and Hinds

[57] ABSTRACT

Marine sediment contains organic matter which can be extracted to provide a source of energy, by extracting the organic matter from the marine sediment when in the form of a slurry, and separating the organic matter from the extracted material.

13 Claims, 5 Drawing Figures

EXTRACTION OF ORGANIC MATTER FROM MARINE SEDIMENT

This invention relates to the extraction of organic matter from marine sediments.

Unconsolidated marine sediments cover a large part of the sea floor to depths which can exceed 300 meters. Owing to their low organic content (generally in the range 0.5 to 15% by weight), these sediments have not been previously considered as a source of fuel or of raw materials for organochemical and food production. It is estimated that the total oxidation of this organic matter, consisting mainly of crude proteins and carbohydrates and amounting to some $3 \times 10^{14}$ tons, would consume most of the oxygen in the atmosphere, with the production of water vapour and an environmentally unacceptable amount of carbon dioxide. In view of this, only a small fraction (perhaps 1%) is likely ever to be consumed. Even so, it could suffice to meet a substantial part of world energy and raw material requirements for the next century.

Although pelagic (deep sea) sediments contain most of the organic matter by virtue of their relatively large volume, terrigenous sediments are likely to be the more economically workable, as their content of organic matter is generally higher (usually from 2.5 to 15%) and they occur in shallower water and nearer coastlines, on continental shelves and slopes and in sheltered basins. Promising and favourably situated locations can be assessed by preliminary examination of core samples drawn by survey ships from these locations.

In the Provisional Specification filed with my British Patent Application No. 24975/76, there are described a method of extracting organic matter from a marine sediment, which method comprises:

recovering the marine sediment in the form of a slurry in water;

separating off from the slurry by sedimentation, particles of a mainly inorganic nature, to leave an aqueous suspension;

extracting organic matter from the aqueous suspension, with an organic solvent; and separating the organic solvent from the organic matter, to leave the desired organic matter:

a plant suitable for use in the extraction of organic matter from a marine sediment, which plant comprises:

recovery means for recovering marine sediment in the form of a slurry in water;

first separation means for separating off particles from the slurry by sedimentation;

extractions means for extracting organic matter from a suspension, with an organic solvent, and second separation means for separating organic solvent from organic matter:

a floatable and sinkable plant which includes a probe movable between a retracted position and a downwardly extended position, the probe being provided with a first passageway for downward travel of compressed air, a second passageway for downward travel of water, and a third passageway for upward travel of a slurry of water, sediment and compressed air, the upper end of the third passageway opening into a tank to allow for escape of the compressed air, the lower end region of the probe being provided with apertures to allow sediment from outside the probe to be drawn, in use, into the probe:

and a plant comprising:— a comminutor; separation means for separating off particles from a slurry to be fed from the comminutor, by coarse sedimentation; a tilted plate separator for separating off particles from the slurry to be fed from the coarse sedimentation separators, by fine sedimentation; an extraction tower with provision for feeding organic solvent in counterflow to the slurry; a distillation column for separating organic solvent from organic matter recovered from the slurry; and a condenser for condensing organic solvent distilled off in the distillation column.

In the Provisional Specification filed with my British Patent Application No. 46028/76, there are described a method of extracting organic matter from marine sediments, which method is a modification of that disclosed in Provisional Specification No. 24975/76, in which modification, preferably at a stage after the particles of mainly inorganic nature are separated off by sedimentation and before the organic matter is separated with an organic solvent from the aqueous suspension, the aqueous suspension is subject to an elevated temperature and pressure to rupture cohesive bonds between organic and inorganic matter in the aqueous suspension;

and a plant comprising a comminutor; separation means for separating off particles from a slurry to be fed from the comminutor, by coarse sedimentation; pressure vessel means for heating under pressure the slurry fed from the separating means; an extraction vessel with provision for feeding organic solvent to the slurry fed from the pressure vessel means; means for separating the organic phase containing organic matter from an aqueous phase containing inorganic matter; a distillation vessel for separating organic solvent from organic matter recovered from the slurry; and a condenser for condensing organic solvent distilled off in the distillation vessel.

According to one aspect of the present invention, there is provided a method of extracting organic matter from a marine sediment, which method comprises:

recovering the marine sediment in the form of a slurry in sea water;

extracting organic matter from the slurry with an organic liquid; and separating the organic liquid from the organic matter, to leave the desired organic matter.

According to another aspect of the present invention, there is provided a plant suitable for use in the extraction of organic matter from a marine sediment, which plant comprises:

recovery means for recovering marine sediment in the form of a slurry in sea water;

extraction means for extracting organic matter from a slurry, with an organic liquid, and separation means for separating the organic liquid from the organic matter.

According to a further aspect of the present invention, there is provided a floatable and sinkable sea plant which includes a probe movable between a retracted position and a downwardly extended position, the probe being provided with a first passageway intended for downward travel of pressurised water, and a second passageway intended for upward travel of a slurry of water and sediment, an upper region of the second passageway being in communication with a comminution chamber, and a lower end region of the probe being provided with first apertures to allow water to be injected from the first passageway into the sediment, with second apertures to allow the slurry so formed to pass from outside the probe to the second passageway, and means for injecting organic liquid into the slurry upstream of the comminution chamber.

Conveniently the comminution chamber is annular and surrounds the upper end region of the probe when the latter is in its downwardly extended position, there being further apertures between the second passageway and the comminution chamber.

Preferably the sea plant also includes a coagulation chamber (downstream of the comminution chamber) and, further downstream, a tilted plate separator for separating by flotation the mixture of organic liquid and suspended organic matter from the remainder of the slurry. Such a sea plant comprises the recovery and extraction means of the plant of the second-mentioned aspect.

For effecting the separation stage referred to in the method according to the first-mentioned aspect of the present invention, there can be provided a land plant comprising a distillation column for separating organic liquid from organic matter recovered from the slurry; and a condenser for condensing organic liquid distilled in the distillation column. The distilled organic liquid may be recycled with very little loss to the extraction equipment on the sea plant.

For a better understanding of the present invention, and to show how the same may be carried into effect, reference will now be made, by way of example, to the accompanying drawings, in which.

Figure 1:
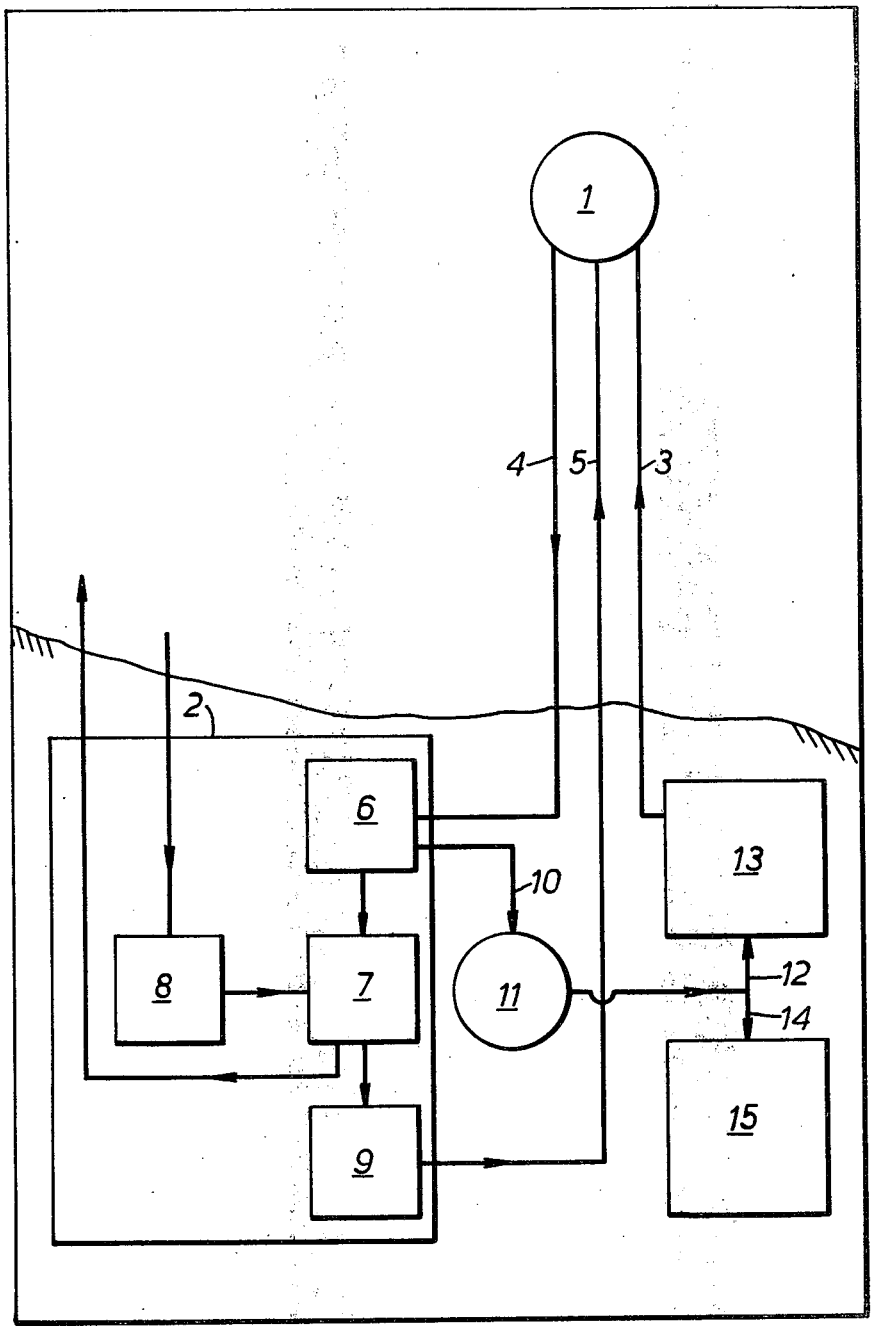
FIG. 1 is a block diagram of one embodiment of a plant in accordance with the second-mentioned aspect of the present invention.

Referring first to FIG. 1 of the accompanying drawings, the plant includes a stationary offshore or sea plant 1, resting on the sea bed and located within an area having an extensive, thick layer of marine sediment rich in organic matter; the plant 1 is linked with an onshore or land plant 2 by two submerged pipelines 4 and 5 and is provided with power by a submarine electric power cable 3, for the operation of the sea plant 1. The pipeline 4 is used for conveying a mixture of organic liquid and extracted organic matter from the sea plant 1 to the land plant 2. The pipeline 5 is for conveying the distilled organic liquid back from the land plant 2 to the sea plant 1. The distance between the two plants 1 and 2 could be, for instance, from 5 to 20 km. The land plant 2 comprises a distillation column 6 supplied by the pipeline 4, a condenser 7 in which the organic vapour from the distillation column 6 is condensed, a pump 8 for supplying cooling sea water to the condenser 7, and a pump 9 for returning the recovered organic liquid to the sea plant 1 through pipeline 5. The output from the distillation column 6, other than the organic liquid recycled through pipeline 5, consists essentially of a dense slurry of mainly organic solids admixed with some finely divided inorganic contaminants and some organic liquid, and is conveyed by a pipeline 10 to a storage tank 11, from which it may be transmitted by a pipeline 12 to a power station 13 for use as fuel, or by a pipeline 14 to a chemical plant 15 for further refining and processing to obtain gaseous and liquid fuels, organochemicals, or proteins and carbohydrates. These proteins and carbohydrates may be used independently or blended together and used as fertilizers, cattle or poultry feed or even directly used as human food after suitable sterilising, texturing and flavouring. Alternatively, some of the organic matter may be pyrolysed for methane production, to be used either as a fuel or as a feedstock for the synthesis of methanol and the production of single cell protein food. Also, some or all of the unprocessed organic matter in the storage tank 11 may be exported by tanker to distant markets.

The components making up the land plant 2 and submarine connections to the sea plant may be of a conventional nature and will therefore not be further described here.

Figure 2:
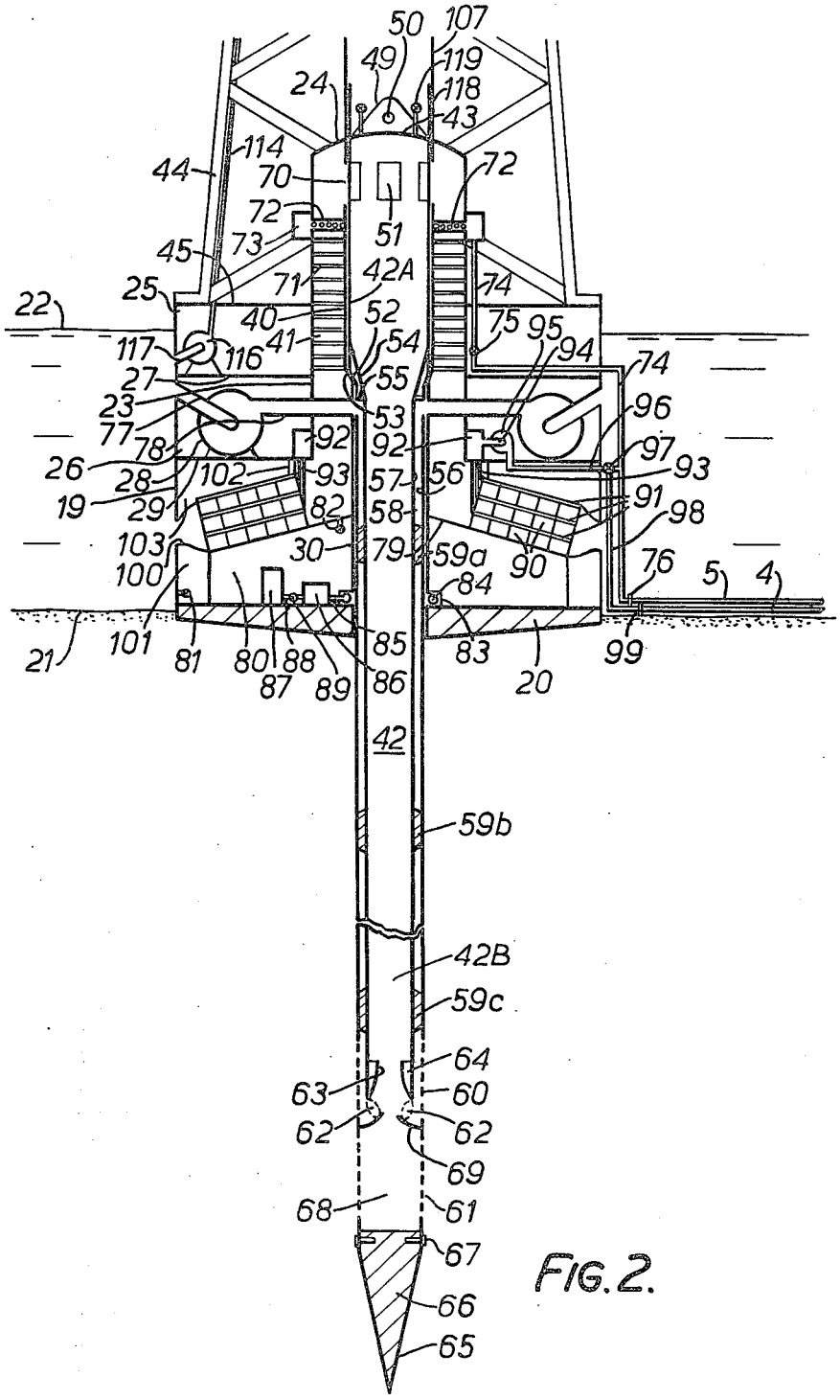
FIG. 2 is a vertical section through the lower part of one embodiment of a sea plant for recovering marine sediment from the sea bed and for carrying out the main process of extraction, with the probe in the downwardly extended position.

FIG. 2 shows the lower part of a sea plant 1 in detail. The sea plant has a main body 19 in the form of a watertight, buoyant, generally cylindrical structure of welded steel sheets secured to a rigid internal frame of steel girders. In a lowermost region of the body 19 is a ballast chamber 20, filled with a dense slurry such as haematite slurry and resting on the sea floor 21, with the water surface at 22. Located within intermediate and upper regions of the body 19 is a vertical cylindrical partition 23 which is capped by an annular dome 24. Located between the body 19 and vertical partition 23 are upper and lower annular compartments 25 and 26, separated by a horizontal partition 27. The top compartment 25 is defined by the roof of the main body 45 and the bottom of compartment 26 is defined by a horizontal partition 29. Crew quarters and control room are located in compartment 25, and compartment 26 is a pump house in which are located water pressurising pumps 28, electrically driven and secured to horizontal partition 29. Located centrally within the vertical partition 23 is an inner vertical cylindrical partition 40 which defines an annular compartment 41. The partition 40 is joined to another vertical cylindrical partition 30 by bearing surface 53. Located centrally within the vertical partition 40 is a retractable probe generally indicated by the reference numeral 42, the upper part of which 42A is capped by a circular dome 43, and the lower part of which, 42B, can either project far below the ballast chamber 20, as shown in FIG. 2, or be retracted generally within the body 19.

Figure 3:
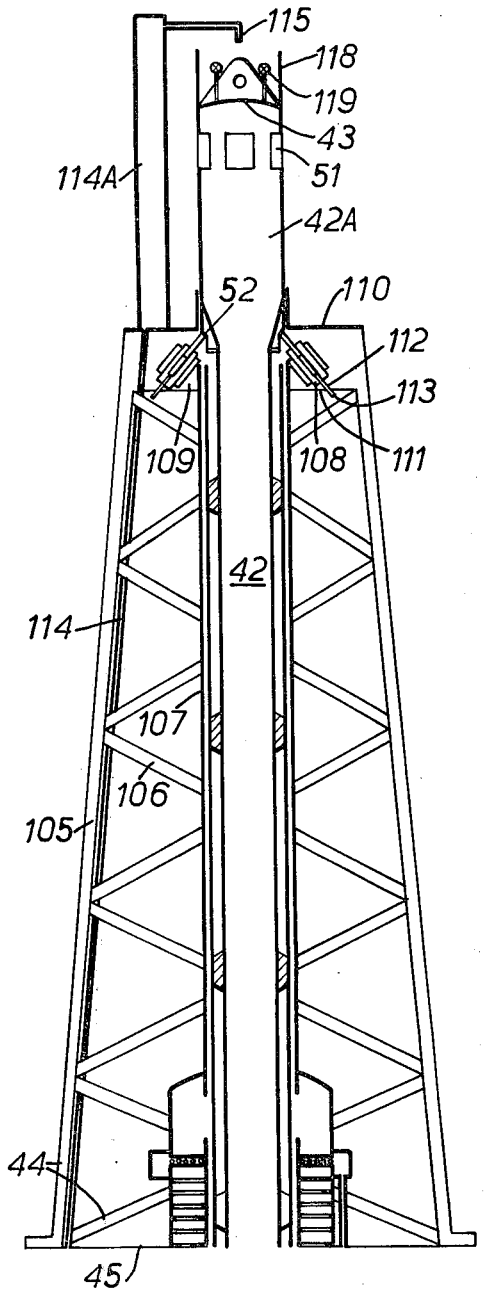
FIG. 3 is a vertical section through the upper part of the same offshore plant, with the probe in the retracted position.

A derrick 44 is mounted above the roof 45 of the main body 19 of the sea plant, and only its lower part shown in FIG. 2. This derrick 44 has open network of steel girders, and is shown in FIG. 3.

Reverting to FIG. 2, a triangular plate 49 is welded to the dome 43, and is provided with a central aperture 50 which can be used for lifting purposes during the construction and insertion of the retractible probe 42. The upper part of the probe 42A is provided with a number of large rectangular apertures 51. Further down the probe is a bevelled surface 52 which transmits the weight of the probe to the cooperating bearing surface 53 and a conical duct 54, the upper end of which is welded to the inner wall of the upper part 42A of the probe 42, and the lower end of which is secured by a horizontal annular collar 55 to an outer tube 56 of the probe. The central part of the probe has two coaxial tubes, the outer tube 56 and, separated therefrom, an inner tube 57 thereby forming an annular cylindrical space 58. The separation is effected by spacers in the form of radial fins 59*a*, 59*b* and 59*c* which are welded at regular intervals to the two coaxial tubes 56 and 57. The lowermost part of the outer tube 56 is provided with two contiguous perforated regions 60 and 61. The lower end of the annular space 58 is terminated by a plate 69 which also separates the two perforated regions 60 and 61. Ports 62 lead from the annular space 58 to a central upwardly converging duct 63 which is held in position by radial fins 64. The ports 62 form a jet pump which draws fluid and sediment from a space 68 below the plate 69 through a central aperture in plate 69. The lowermost part of the probe terminates in a hollow conical metal chamber 65 filled with ballast 66, which is secured to the lowermost part of the perforated tubular region 61 by bolts 67.

The annular compartment 41 is provided with a set of rectangular apertures 70 which coincide with the corresponding probe apertures 51 (when the probe is in the downwardly extended position). Compartment 41 contains a large number of symmetrically disposed radial girders 71, typically made of angle steel with their corners uppermost. These girders are only shown diagrammatically in FIG. 2 and would be more densely packed than shown in FIG. 2. Between the lower edges of apertures 70 and the uppermost girders 71, there is provided a set of perforated radial tubes 72, equally spaced and secured at one end to the vertical partition 40, and connected at the other end to an annular distribution chamber 73, which is linked by pipe 74 to the submarine pipeline 5 shown in FIG. 1. This pipe 74 is fitted with a flow rate control valve 75 and is joined to pipeline 5 by the submarine flanged joint 76.

Each pressurising water pump 28 is connected to the open sea by a water intake pipe 77, and to the annular space 58 by a pipe 78 passing through the vertical partition 23 and partition 30. The lower end of compartment 41 is defined by the shallow conically shaped partition 79. Between partition 79 and ballast chamber 20 is a large annular space 80 which is initially filled with air. This annular space 80 can be permanently flooded by opening the water inlet valve 81 and the air venting valve 82, both of which are remotely operable by mechanical, hydraulic or electric means from the control room in the upper annular compartment 25.

At the base of chamber 80 there is provided a small annular housing 83 which is open on its radially inner face and contains a deformable rubber or plastic tube 84 connected by pipe 85 to a container 86 filled with semi-hydrated gypsum powder, $2CaSO_4.H_2O$, the chief constituent of plaster of Paris. An air pressurised water vessel 87 is connected to container 86 by a tube 88 and a remotely operable valve 89.

Situated above, and supported by, the partition 79 are stacks of tilted plate separators 90 of the type described hereinbelow with reference to FIGS. 4 and 5. As shown in FIG. 2, three inclined annular collecting channels 91 are connected to an annular chamber 92 by vertical tubes 93. The annular chamber 92 is connected by an outlet pipe 94 to a pump 95 which in turn is connected to a pipe 96. The pipe 96 is fitted with a flow splitting valve 97 which divides the flow between the pipe 74 and a pipe 98. The pipe 98 is connected to the submarine pipeline 4 shown in FIG. 1 by a flanged joint 99. The upper end of the bank of tilted plate separators 90 is in direct communication with the lower end of compartment 41, while the lower end communicates with the open sea through a number of convergent outlet ducts 100 which are supported by vertical radial partitions 101 bearing on ballast chamber 20. The outlet ducts 100 are radially disposed, and the vertical portions of tubes 74 and 98 external to the sea plant are located midway between two ducts of an adjacent pair, rather than on the axis of a particular outlet duct as shown for convenience in FIG. 2. A vertical cylindrical partition 102 separates an air-filled chamber 103 from the lower end of compartment 41.

The upper annular compartment 25 is provided with a water pressurising pump 116 which can draw in sea water along an inlet pipe 117 and discharge it along a pipe 114 which is secured to derrick 44. Also probe 42 is provided with a cylindrical wall extension 118, and dome 43 is provided with water valves 119, which can also be used as air vents.

FIG. 3 shows a vertical section of the upper part of the sea plant 1 which plant is used to transport and then release the retracted probe 42. The derrick 44 comprises a set of slightly convergent girders 105 which are stiffened by cross girders 106. Additional girders, not shown, secure a central vertical tubular shaft 107 to the derrick. The upper part of the central probe is shown in FIG. 3 in its fully retracted position, with the lowermost part (not shown) of the probe level with ballast chamber 20 of FIG. 2. The probe 42 is located within the vertical tubular shaft 107, with an appreciable clearance between the inner surface of the shaft 107 and the outer surface of the probe 42. The weight of the probe 42 is transmitted through its bevelled surface 52 to a number of hydraulically pressurised jacks 108 which are radially mounted on vertical partitions 109. These partitions 109 are secured to upper and lower horizontal platforms 110 and 111 respectively. The axis of each jet is set perpendicular to the bevelled surface 52. At the other end of each jack there is provided a tubular extension 112 which is similarly pressurised and terminates in an explosive cartridge 113. Pipe 114 is connected through a stiff vertical extension 114A to a downwardly discharging orifice 115.

Figure 4:
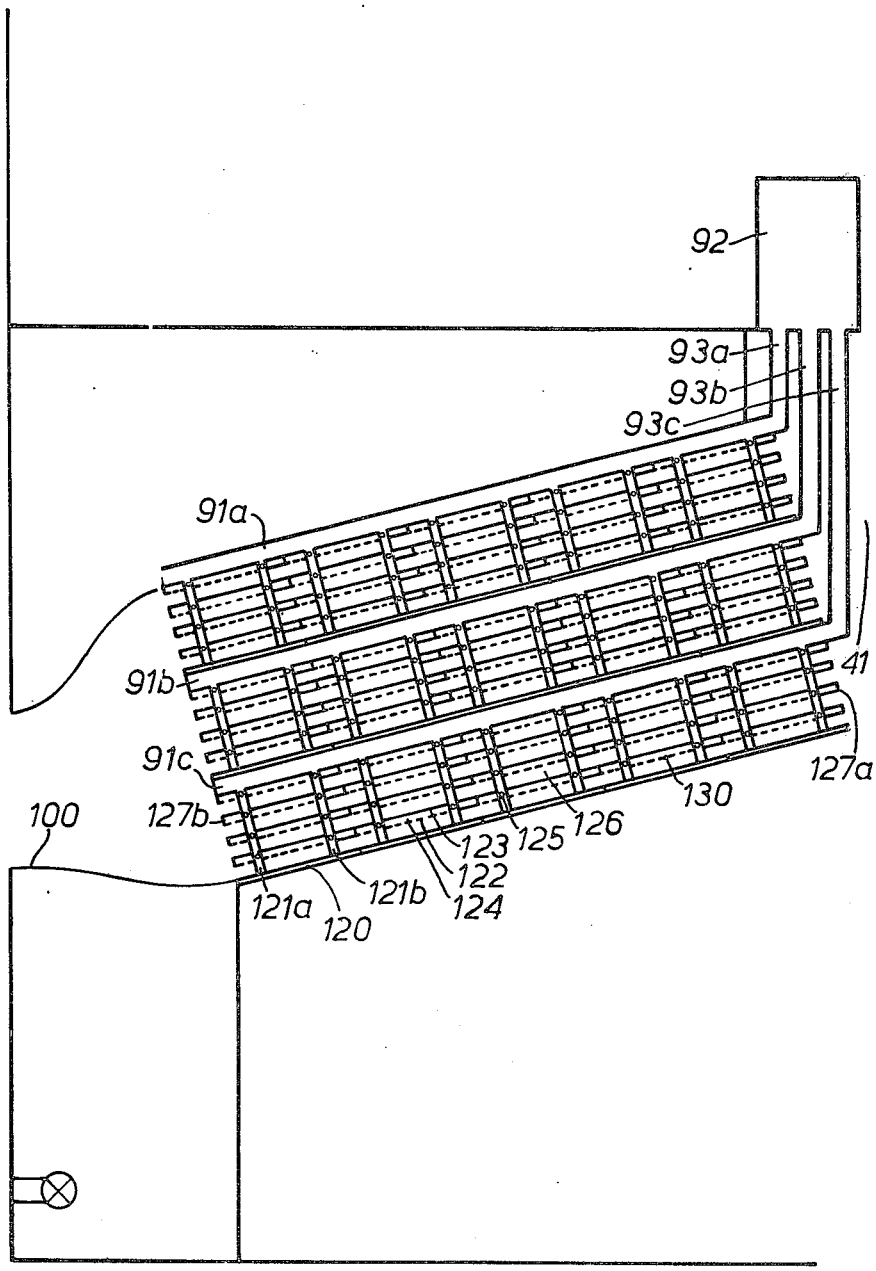
FIG. 4 is a vertical section through a plurality of stacks of tilted plate separators, forming part of the sea plant.

Reference will now be made to FIG. 4 which shows an enlarged vertical section through the bank of tilted plate separators 90 of FIG. 2 and to FIG. 5 which shows in greater detail the tilted plate separators of FIG. 4. For illustrative purposes, three separate parallel layers of tilted plates are shown, each consisting of five prefabricated units mounted in series. Each prefabricated unit consists of a heavy gauge base plate 120, to which are secured, by welding or otherwise, tubes 121*a* and 121*b*. These tubes, fitted with annular spacers not shown in FIG. 4, serve to support a large number of similar parallel pairs of plates. Plates 122 and 123 form the lowest of these pairs, which are more closely spaced than can conveniently be shown. The lower plate 122 contains a large number of small perforations 130, of order 5 mm diameter, while the upper plate 123 is only perforated where necessary to allow tubes 121 to pass through it. A space 124 between plates 122 and 123 communicates with the inside of the supporting tubes 121 through radial holes 125 in tubes 121 which are located to coincide with the upper part of the space 124. There are spaces 126, which are larger than spaces 124 between successive pairs of plates 122 and 123. The upper end of each tube 121 is in communication with a collecting channel 91*a*, 91*b* or 91*c*. The vertical tubes 93 of FIG. 2 are shown more clearly as tubes 93*a*, 93*b* and 93*c* in FIG. 4. The lower ends of these tubes are connected to the collecting channels 91*a*, 91*b*, 91*c* respectively, and their upper ends are connected to the annular chamber 92. The spaces 126 are in direct communication with compartment 41 at their upper end, and with the convergent outlet ducts 100 at their lower end. The spaces 124 are sealed at their extremities by vertical partitions 127*a* at the upper end and 127*b* at the lower end which isolate spaces 124 from compartment 41 and ducts 100 respectively.

Figure 5:
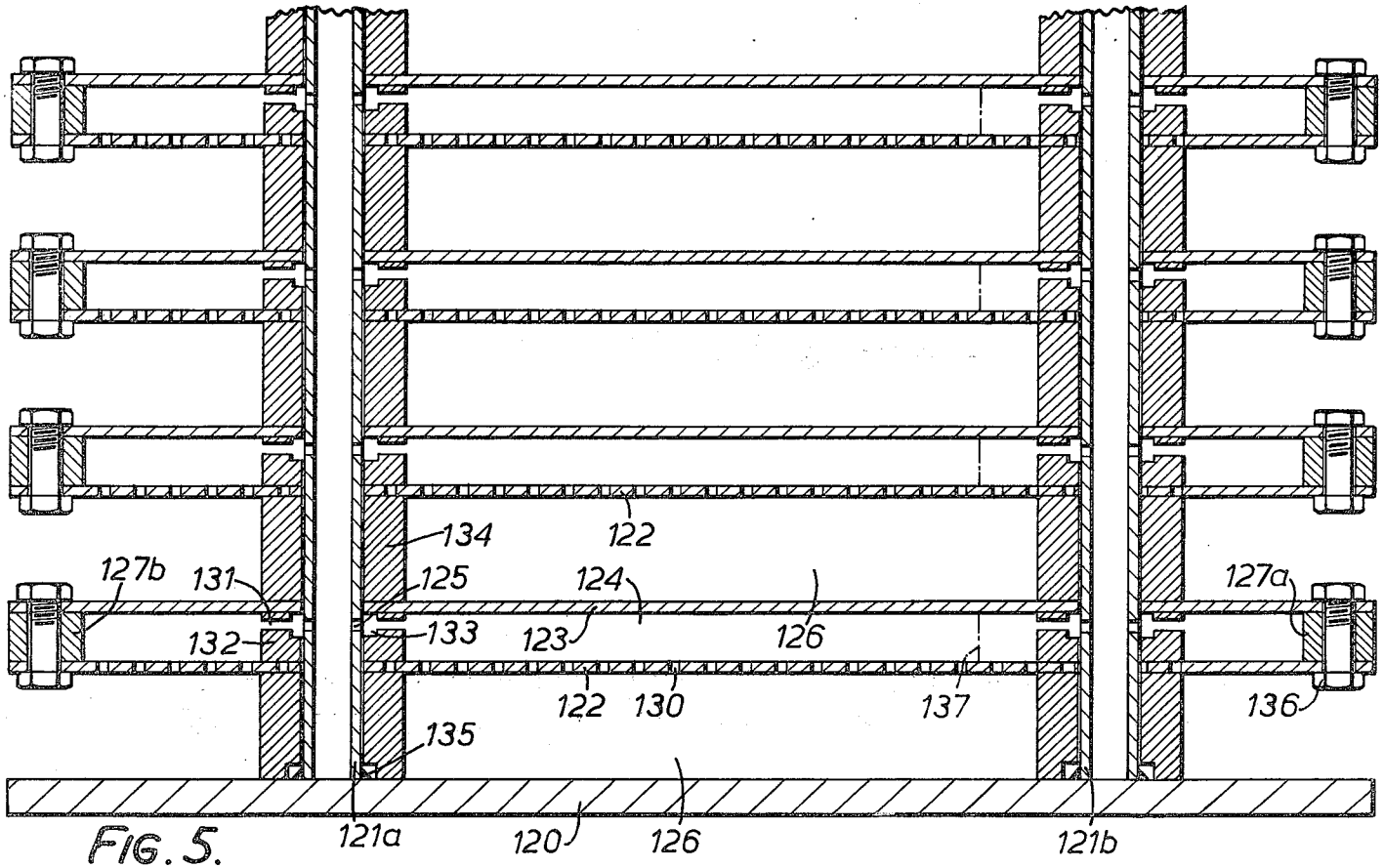
FIG. 5 is a vertical section showing in greater detail the structure of a stack of such tilted plate separators.

FIG. 5 shows the approximate relative thickness of each component of a separator 90, and their spatial relationship. However, for convenience the tilt of the separator 90 is not shown in FIG. 5, and it is not practical to show correctly in that Figure the full horizontal extent of plates 120, 122 and 123 previously described. The plates 122 are provided with perforations 130 which allow upward passage of buoyant organic liquids or suspensions from space 126 to space 124, which communicates with tubes 121*a*, 121*b* through radial holes 131 in annular spacers 132. The spacers 132 are provided with an upper internal annular recess 133 to facilitate passage of liquid from radial holes 131 to radial holes 125 in tubes 121*a* and 121*b*. Further annular spacers 134, which are taller than spacers 132, separate each of the plates 123 from the respective plate 122 above the plate 123. The lowermost of spacers 134 is recessed at its base to accommodate the fillet of a welded joint 135. Each pair of plates 122 and 123 separated by spacer 132 is secured to vertical partitions 127*a*, 127*b*, which also form a frame, by bolts 136, producing a shallow box which encloses the space 124. Girders, not shown, inserted between these plates 122 and 123 and secured to them, run from the lowermost edge 127*b* of the frame to an upper extremity 137, and serve to stiffen each box and to channel the upward flow of buoyantly separated organic suspension.

The operation of the sea plant 1 will now be described. Starting with the sea plant on shore, it is launched from a slipway or by flooding a dry dock, and is then towed to the desired location with its central probe fully retracted. There it is sunk into position by remotely opening, from the control room in compartment 25 shown in FIG. 2, the water inlet valve 81 and air venting valve 82, resulting in the flooding of annular space 80 and loss of buoyancy. Only the upper part of the plant then remains above the water surface 22, any variation in depth of water depending on winds and tides. The retractable probe 42 is then flooded by operating the high pressure water pump 116, causing water drawm from the sea via pipe 117 to be discharged by pipe 114 and orifice 115 into the extension 118 of probe 42 and through valves 119 into the lower part of the probe. The retractable probe 42 is then released by the simultaneous electrical detonation of cartridges 113 shown in FIG. 3. This causes each hydraulic jack 108 to be depressurised, as the pressurising liquid can flow out through the ruptured tubular extensions 112. The jacks supporting the retracted probe are then thrust aside by the weight of the probe, and the probe 42 is released, passing through the vertical shaft 107. The probe 42 then penetrates steadily through the unconsolidated sediment on the sea bed, which is fluidised by gradual injection of sea water through valves 119 and perforated regions 60 and 61. Water injection is terminated by switching off pump 116 when the bevelled surface 52 comes to rest against the corrresponding bearing surface 53 shown in FIG. 2. Flanges 76 and 99 are then bolted by divers to submarine pipelines 5 and 4 shown in FIGS. 1 and 2.

The small annular clearance between probe 42 and its vertical partition 30 is next sealed off by remotely opening valve 89. The pressurised air drives water out of vessel 87 into the gypsum powder held in container 86, turning it into a fluid paste which is forced through pipe 85 into the annular plastic or rubber tube 84. Tube 84 then seals off permanently the annular clearance between the probe 42 and vertical partition 30, as the plaster of Paris expands and sets.

Next the water pump 28 is started, drawing in sea water through the inlet pipe 77 and discharging it, under pressure through pipe 78 into the annular cylindrical space 58. Part of the water flows inwards through the ports 62 situated in the lower part of probe 42, whereas another part of this water is injected outwardly through perforations 60 into the unconsolidated but cohesive sediment, which is fluidized and enters under suction into the lowermost part of probe 42 through perforations 61. The suction is derived from the converging duct 63 fed by ports 62, which entrains the slurry upwards through the converging duct 63. The slurry thus entrained and water from the ports 62 mix as they travel upwards along the inner tube 57 of probe 42. Next, the diluted slurry reaches apertures 51 and 70, and as it is prevented from further upward travel by domes 43 and 24, is discharged into the annular compartment 41. The air beneath dome 43 escapes through valves 119, which are then closed permanently.

The extracting organic liquid, which is likely to be petroleum ether, is delivered from the land plant 2 by the pressurising pump 9 shown in FIG. 1 along pipeline 5, and passes along pipe 74 and through valve 75 into the annular distribution chamber 73. It is then injected under pressure into the path of the downward flowing slurry in compartment 41 through the perforated radial tubes 72. The resulting mixture of slurry and organic liquid is then further mixed and comminuted by passage through the array of radial girders 71, which are more closely packed than shown in FIG. 2. The separation between the girders should however exceed the size of the perforations in region 61, in order to avoid clogging by any pebbles that may be mixed with the slurry. Passage of the comminuted slurry into the lower part of compartment 41 is accompanied by rapid coagulation of the organic extracting liquid, which is now laden with organic matter extracted from the marine sediment. The efficiency of extraction is expected to be of order 30–35 percent, being limited by the strong cohesive bonds between some of the organic and silt particles, which are only ruptured to a limited extent by intense comminution. However, bulk experiments and subsequent microscopic examination have shown that the liberated part of the organic matter tends to concentrate almost exclusively in the organic liquid phase in preference to the aqueous phase, possibly due to a surface tension effect. The chief advantages of petroleum ether over other possible extracting liquids are its almost total immiscibility with water, its low density and low boiling point, combined with its great affinity for suspended organic particles. This affinity produces droplets in which most organic particles are merely suspended in petroleum ether rather than dissolved by it. Petroleum ether shows no such affinity for suspended inorganic particles, which therefore remain substantially dispersed in the aqueous phase.

The slurry next enters the stacks of tilted plate separators 90 as a mixture of inorganic slurry and organic droplets, preferably travelling at an initial speed of the order of 30 cm per second, which is approximately halved at the exit of the separators. As the slurry moves radially outward, through the spaces 126, the buoyant organic droplets rise rapidly, and pass into space 124 through the perforations 130 of plates 122. This space 124 is sheltered from the appreciable turbulence in space 126, allowing the droplets to rise against the undersurface of tilted plate 123. Under these conditions, the droplets further coagulate from the mixture of water and very fine silt which is also present in space 124. Guided by the radial girders (not shown) up to their upper extremity 137, the resulting supernatant organic suspension enters through the radial holes 131 of spacers 132 into the annular recesses 133 and thence through the radial holes 125 into one or other of the collecting tubes 121*a* and 121*b*. These tubes discharge the organic suspension into the inclined collecting channels 91*a*, 91*b* and 91*c* which convey the organic suspension along tubes 93*a*, 93*b* and 93*c* into the annular chamber 92. The pump 95 draws the organic suspension from chamber 92 through pipe 94, and discharges it through the pipe 96 and the flow-splitting valve 97 into pipes 74 and 98. The part of the flow directed into pipe 74 is admixed with pure organic liquid returned from the land plant by submarine pipeline 5 and is recycled into the extraction plant through the annular distribution chamber 73 and perforated radial tubes 72, while the remainder of the flow is directed into pipe 98 and conveyed to the land plant along submarine pipeline 4. The object of this division of flow is to increase the relative proportion of organic extracting liquid to sea water, and yet achieve a high concentration of the desired extracted organic matter in the organic suspension conveyed from the sea plant to the land plant.

The spent slurry, freed of extractable organic matter, proceeds along spaces 126, together with the fine silt suspension discharged through perforations 130 at the lower end of plates 122, and is ejected into the sea in the form of high velocity jets (of order 5 m $s^{-1}$) through a small number of convergent ducts 100. This ensures that the spend slurry is widely dispersed as a mobile layer of liquid mud in all directions, and does not accumulate in the vicinity of the sea plant.

In spite of the toxicity of petroleum ether to many marine species, the environmental impact of these operations is likely to be maintained at an acceptably low level, owing to the very high separation efficiency of the particular form of the tilted plate separators described with reference to FIGS. 4 and 5. The use of a number of these separators in series ensures almost total removal of all organic droplets by flotation, only some of the smallest droplets failing to be captured. Coagulation of most fine droplets with larger droplets ensures that their total residual volume at the point of discharge is very small indeed in relation to the very large flow of slurry. Most of these fine droplets are then trapped in the concentrated slurry as it sediments out of suspension at some distance from the jet outfalls, while those remaining in suspension are rapidly diluted with large amounts of sea water, which is dispersed by tidal currents, producing an exceedingly low concentration in the main body of sea water. Moreover, liquid hydrocarbons including petroleum ether are admixed to some extent with natural marine sediments, which are occasionally mobilised by storms on continental shelves. Thus there already exists an appreciable natural background of petroleum ether in sea water.

Although the foregoing description of one embodiment of the sea plant given above is necessarily very specific as to detail, nonetheless considerable variations are possible whilst remaining in accordance with the present invention. For example, some alternative disposition of pipes 78 of FIG. 2 could make it possible to bolt them to vertical flanges on the retractable probe 42, especially at low tide, thereby avoiding the need for plant components 85 to 89. This, coupled with the possibility of driving out water from the flooded annular space 80 using an air compressor, would enable the probe 42 to be retracted again, allowing the plant to be transferred from a worked out site to a new site. Alternatively the derrick 44 and associated components shown in FIG. 3 could be dismantled after lowering the probe and used on another plant. Also the length of probe, and thus the thickness of sediment available for processing, need not be limited by the height of the derrick if the latter is designed to accommodate several lengths of probe, which could be welded or bolted together in situ. Similarly, the hydraulic jack 108 could be pressurised by a single high pressure air receiver, and the subsequent depressurisation of the jacks and release of the probe achieved by venting the compressed air through a single valve to the atmosphere.

Whilst the present invention particularly contemplates hydraulic excavation of the sediment, nonetheless the injection of auxiliary compressed air could be used to faciliate the upward flow of slurry along the central part of the probe. However, this air lift method already well proven, requires additional equipment and subsequent deaeration of the slurry before its entry into the communution chamber. Comminution itself could be achieved by a mechanical stirrer of substantial size, but since only relative motion between fluid and solid elements is all that is needed for this purpose, the proposed arrangement illustrated in FIG. 2, involving no working parts appears to be preferable. Also other forms of tilted plate separator are commercially available, but the novel design illustrated in FIGS. 2, 4 and 5 appears to offer high efficiency of recovery of petroleum ether, (and the organic matter entrained therein), which is important from the anti-pollution and economic points of view.

The height of annular space 80 and compartment 25 could be varied according to the depth of water in which the sea plant will be working while keeping the rest of the design unchanged. This facilitates the production of a large number of sea plants of basically standard design.

The present invention will now be illustrated by the following Example.

EXAMPLE

Consider a medium size coastal plant with an organic output of 100 kg $s^{-1}$. Assuming a marine sediment containing an average 6% of organics by weight on a dry basis, of which one third is recovered, the required dredging rate is 5 tonnes $s^{-1}$ of dry sediment. If the slurry contains 90% of water by weight, then slurry must circulate through the plant at a rate of 50 $m^3s^{-1}$. Given a central tube cross-section of 5 $m^2$ (and an overall probe diameter of order 3.5m) the velocity of the slurry up the central tube of the probe must be $10ms^{-1}$.

The slurry may need to be lifted, say, 5m above the sea level. The sea plant can have a diameter of, say 22m, a height of 16m and a total displacement of about 6000 $m^3$. Such a plant could contain 3000 tons of water and slurry and weigh itself 3000 tons. Thus theoretically the sea plant could be operated to produce its own weight of organic matter in just 30000 seconds or about 8 hours. Even if the effective continuous productive life of the plant is only 10 years or $3\times10^8$ seconds, it could theoretically yield 10000 ties its weight of organic matter over this period.

If water ballast accounts for a third of the fluid weight within the plant, then the weight of slurry is about 2000 tons, and with a plant throughput of 50 $m^3s^{31\ 1}$, this implies a transit time through the plant of 40 seconds, excluding the time taken for the slurry to travel up the central shaft. This very brief transit time suggests an economic process, especially as much of the plant requires no sophisticated engineering. By contrast, the corresponding time that would be need for biogasification of the organic matter in the sediment would be of order $2 \times 10^6$s or 50000 times longer.

The processing of 5 tonnes of dry sediment per second, or about $2m^3s^{-1}$ for $3 \times 10^8$s implies access to a sediment volume of $6 \times 10^8m^3$. If the thickness of the sedimentary layer processed is a modest 60m, the required area of the deposit is $10km^2$, corresponding to a circle of radius 1.8 km. There should exist, around the British Isles and elsewhere throughout the world, a large number of suitable sites located within 2–3 km from the coastline, and a correspondingly limited length of required submarine pipelines and cables. More distant plants would tend to be located over thicker, more extensive layers of unconsolidated sediment, which could warrant the use of sea plants of considerably larger size and output than the one discussed here by way of illustration. However, the economies that may result from large scale operation tend to be cancelled out by the added length of submarine connections, so that plant economics are likely to be somewhat unrelated to plant size, and even the operation of a pilot plant could be quite economic.

If the output of the sea plant contains 50% petroleum ether by weight then pipeline 4 must carry ashore 200 kg $s^{-1}$, or about 0.22 $m^3s^{-1}$ if the mixture density is 900 kg $m^{-3}$. If the mean velocity of flow is $2ms^{31\ 1}$, the required internal pipe diameter is 37.5 cm. Taking the density of pure petroleum ether as 720 kg $m^3$, its return flow rate from land to sea plant is 100 kg $s^{-1}$ or 0.14 $m^3s^{-1}$ . This pure liquid can be returned at 4m $s^{-1}$ through a pipe of internal diameter 21 cm.

The mean calorific value of the extracted organic material (excluding the recycled petroleum ether) is 5500 cal $gm^{-1}$. If the heat from an output of 100 kg $s^{-1}$ were converted into electrical power at 30% efficiency, this would yield 690 MW, sufficient to raise the 50 tons of slurry handled per second through a height of 1400m. Since the water pumps are only required to raise the slurry through some 5–10m above sea level, and are likely to operate at 80% efficiency, then even after allowing for the additional work of comminution, it is unlikely that more than 1 or 2% of the potentially available electrical power would be used up by the sea plant. The much smaller quantities of organic liquids to be pumped between the land and sea plants would require an even more negligible power input.

The latent heat of petroleum ether is about 70 cal $g^{-1}$. In addition, twice its weight of organic slurry must be heated in the distillation column 6 shown in FIG. 1, from say 10° C. to 70° C. As this organic slurry has a specific heat of 0.5 cal $g^{-1}$ deg $C^{-1}$, this implies a further heat requirement of 60 cal per gram of extracted organics. Thus the total distillation requirements amount to about 130 cal $g^{-1}$ of recovered organics, or about 2.5% of their calorific value. Thus the distillation process may require the combustion of 2.5% of the organics, through this ignores the economies that could be achieved by using the low grade waste heat from a power station to carry out the distillation process. It seems therefore that no more than 5% of the organic output need be required to carry out all extractive processes and auxiliary operations.

Owing to the high cost, high calorific value and high toxicity of petroleum ether, it is essential that recycling should be effected with very high efficiency, environmental considerations being a stringent requirement. Considering a tilted plate separator made up of 5 units of length 1m each, and a mean flow velocity of 20cm $s^{-1}$ along the plates, the the transit time of droplets is 25 seconds. Allowing for a vertical depth of 3 cm within space 126 of FIG. 5, and some turbulence in that region, only droplets travelling upwards with a mean velocity $v \geqq 0.2$cm $s^{-1}$ are likely to be efficiently intercepted by the separator. The corresponding Stokes radius r is given by $$r = \left(\frac{9\eta v}{2g\Delta\rho}\right)^{\frac{1}{2}}$$

wherein is the viscosity of water (about $10^{-2}$ poise), g is the acceleration due to gravity (981 cm $s^{-2}$) and $\Delta\rho$ is the density difference between the sea water (1.025 g $cm^{-3}$ if the effect of residual suspended particles is discounted) and the droplets. Taking the density of petroleum ether as 0.72 g $cm^{-3}$ and that of the captured organic matter as 1.08 g $cm^{-3}$, the mean density of an equal mixture of these components will be about 0.90 g $cm^{-3}$, so that $\Delta\rho = 0.125$ g $cm^{-3}$. Thus the radius of droplets rising at a velocity of 0.2 cm $s^{-1}$ is 0.085 mm. Experience shows that most droplets coagulate to a radius of 1–2 mm in a matter of seconds, so that only a relatively small number of droplets of radius below 0.1 mm are likely to emerge uncaptured from their 5m journey between plates held 3cm apart. Nevertheless, further research into the optimum dimensions of plate size, separation and flow velocities and regimes may be needed to ensure that sensible pollution standards are not infringed.

I claim:

1. A method of extracting organic matter from a marine sediment, which method comprises:

recovering the marine sediment in the form of a slurry in sea water;

extracting organic matter from the slurry with an organic liquid;

separating by distillation in a distillation column the organic liquid from the organic matter, to leave the desired organic matter; and condensing in a condenser the organic liquid distilled off during the distillation.

2. A method according to claim 1, wherein the organic liquid is petroleum ether.

3. A method of extracting organic matter from a marine sediment, which method comprises:

recovering the marine sediment in the form of a slurry in water;

separating off from the slurry by sedimentation, any particles of a mainly inorganic nature, to leave an aqueous suspension;

extracting organic matter from the aqueous suspension, with an organic solvent; and separating the organic solvent from the organic matter, to leave the desired organic matter.

4. A plant suitable for use in the extraction of organic matter from a marine sediment, which plant comprises:

recovery means for recovering marine sediment in the form of a slurry in sea water;

extraction means for extracting organic matter from a slurry with an organic liquid;

a distillation column for separating organic liquid from organic matter recovered from the slurry; and a condenser for condensing organic liquid distilled in the distillation column.

5. A plant suitable for use in the extraction of organic matter from a marine sediment, which plant comprises:

recovery means for recovering marine sediment in the form of a slurry in water;

first separation means for separating off particles from the slurry by sedimentation;

extraction means for extracting organic matter from a suspension, with an organic solvent;

a distillation column for separating organic solvent from organic matter recovered from the slurry; and a condenser for condensing organic solvent distilled in the distillation column.

6. A plant according to claim 5, which includes a plant comprising: a comminutor; separation means for separating off particles from a slurry to be fed from the comminutor, by course sedimentation; a tilted plate separator for separating off particles from the slurry to be fed from the coarse sedimentation separators, by fine sedimentation; and an extraction tower with provision for feeding organic solvent in counterflow to the slurry.

7. A floatable and sinkable sea plant which includes a probe movable between a retracted position and a downwardly extended position, the probe being provided with a first passage intended for downward travel of pressurised water, and a second passageway intended for upward travel of a slurry of water and sediment, an upper region of the second passageway being in communication with a comminution chamber, and a lower end region of the probe being provided with first apertures to allow water to be injected from the first passageway into the sediment, with second apertures to allow the slurry so formed to pass from outside the probe to the second passageway, and means for injecting an organic liquid into the slurry upstream of the comminution chamber, there also being present a coagulation chamber downstream of the comminution chamber and, further downstream, a tilted plate separator for separating by flotation the mixture of organic liquid and organic matter from the remainder of the slurry.

8. A sea plant according to claim 7, wherein the comminution chamber is annular and surrounds the upper end region of the probe when the latter is in its downwardly extended position, there being further apertures between the second passageway and the comminution chamber.

9. A sea plant according to claim 7, wherein the first passageway at its lower end region communicates with the exterior by perforations and with the second passageway by ports and a converging duct, the probe being provided with further perforations which permit communication between the exterior and a chamber which is in communication with the second passageway via an aperture and the converging duct.

10. A floatable and sinkable plant which includes a probe movable between a retracted position and a downwardly extended position, the probe being provided with a first passageway for downward travel of compressed air, a second passageway for downward travel of water, and a third passageway for upward travel of a slurry of water, sediment and compressed air, the upper end of the third passageway opening into a tank to allow for escape of the compressed air, the lower end region of the probe being provided with apertures to allow sediment from outside the probe to be drawn, in use, into the probe; there also being present means for injecting an organic liquid into the slurry, a coagulation chamber downstream of the tank and, further downstream, a tilted plate separator for separating by flotation the mixture of organic liquid and organic matter from the remainder of the slurry.

11. A sea plant according to claim 7, wherein the tilted plate separator comprises a plurality of stacks of separators with each separator comprising a perforated plate above which is a further plate, the zones between the perforated plate and its respective further plate of each separator in a stack communicating with a duct extending through the plates.

12. A sea plant according to claim 11, which includes spacers for spacing apart the perforated plates and the further plates, and means for directing fluid in a direction generally parallel to the plates.

13. A method as claimed in claim 3 wherein said separating of the organic solvent from the organic matter comprises separating by distillation in a distillation column the organic solvent from the organic matter, to leave the desired organic matter, and condensing in a condenser the organic liquid distilled off during the distillation.

* * * * *